US009054428B2

(12) United States Patent
Fukunaga

(10) Patent No.: US 9,054,428 B2
(45) Date of Patent: Jun. 9, 2015

(54) ANTENNA AND WIRELESS COMMUNICATION UNIT

(75) Inventor: Tatsuya Fukunaga, Tokyo (JP)

(73) Assignee: TDK CORPORATION, Tokyo (JP)

( * ) Notice: Subject to any disclaimer, the term of this patent is extended or adjusted under 35 U.S.C. 154(b) by 750 days.

(21) Appl. No.: 13/333,112

(22) Filed: Dec. 21, 2011

(65) Prior Publication Data

US 2012/0162020 A1 Jun. 28, 2012

(30) Foreign Application Priority Data

Dec. 28, 2010 (JP) ..... 2010-292704

(51) Int. Cl.

| | |
|---|---|
| ***H01Q 1/24*** | (2006.01) |
| ***H01Q 23/00*** | (2006.01) |
| ***H01Q 9/04*** | (2006.01) |
| ***H01Q 1/52*** | (2006.01) |

(52) U.S. Cl.

CPC ..... *H01Q 23/00* (2013.01); *H01Q 9/04* (2013.01); *H01Q 1/526* (2013.01)

(58) Field of Classification Search

CPC ..... H01Q 1/243; H01Q 1/38; H01Q 9/042
USPC ..... 343/702, 700 MS
See application file for complete search history.

(56) References Cited

U.S. PATENT DOCUMENTS

| | | | | |
|---|---|---|---|---|
| 7,463,196 | B2 * | 12/2008 | Hilgers | 343/700 MS |
| 2007/0008228 | A1 | 1/2007 | Yamada et al. | |
| 2007/0013599 | A1 * | 1/2007 | Gaucher et al. | 343/795 |
| 2007/0024398 | A1 * | 2/2007 | Fukunaga | 333/203 |
| 2007/0205851 | A1 * | 9/2007 | Fukunaga | 333/204 |
| 2008/0007468 | A1 * | 1/2008 | Sato et al. | 343/702 |
| 2010/0214177 | A1 * | 8/2010 | Parsche | 343/702 |

FOREIGN PATENT DOCUMENTS

| | | | |
|---|---|---|---|
| CN | 2263405 | Y | 9/1997 |
| CN | 1897354 | A | 1/2007 |
| JP | A-05-183318 | | 7/1993 |
| JP | A-08-222943 | | 7/1996 |
| JP | H-11-068033 | | 3/1999 |
| JP | A-2001-523412 | | 11/2001 |
| JP | A-2002-185206 | | 6/2002 |
| JP | A-2008-067012 | | 3/2008 |
| JP | A-2008-271606 | | 11/2008 |
| JP | A-2009-65354 | | 3/2009 |
| JP | A-2010-206319 | | 9/2010 |
| JP | A-2010-206320 | | 9/2010 |
| WO | WO 98/48473 | A1 | 10/1998 |
| WO | WO 2009/031700 | A1 | 3/2009 |

* cited by examiner

*Primary Examiner* — Dameon E Levi
*Assistant Examiner* — Collin Dawkins
(74) *Attorney, Agent, or Firm* — Oliff PLC

(57) ABSTRACT

An antenna includes: a first resonator and a second resonator each having an open end, in which the first resonator and the second resonator are disposed side by side to allow the open ends thereof to be opposed to each other; and a first capacitor connected between the open ends which are opposed to each other.

11 Claims, 14 Drawing Sheets

FIG. 3A
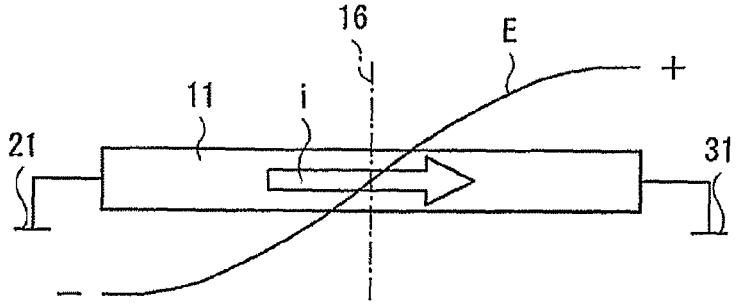
FIG. 3B
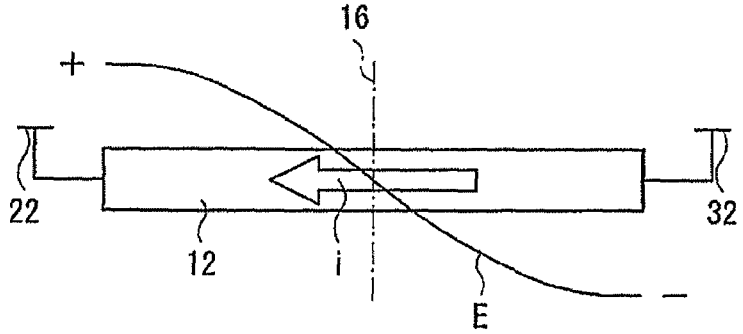
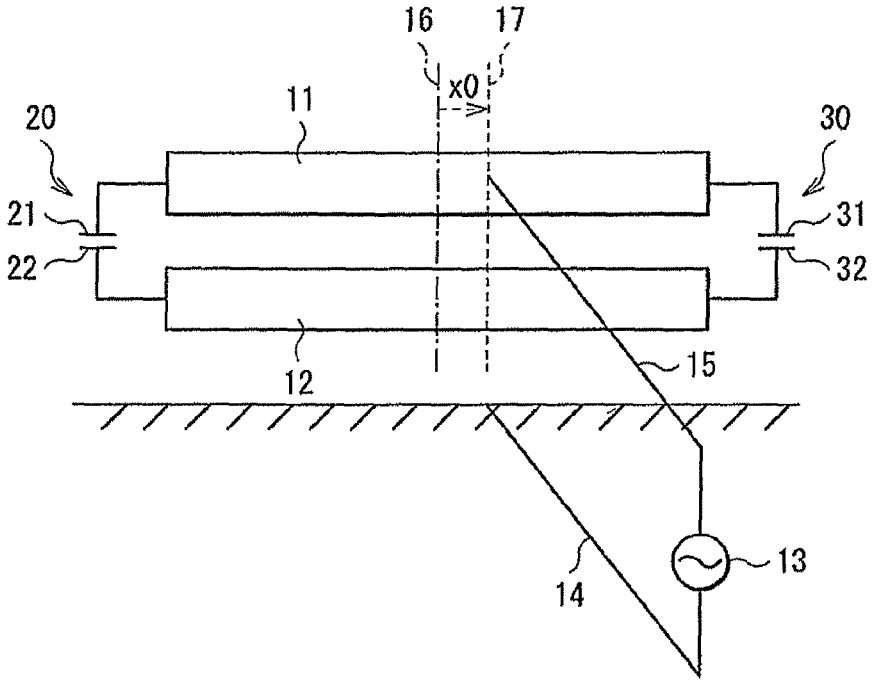
FIG. 4

ANTENNA AND WIRELESS COMMUNICATION UNIT

BACKGROUND

This disclosure relates to an antenna and a wireless communication unit, each of which performs a transmission of a signal (for example, an electromagnetic wave) for a short distance.

A signal transmission unit has been known in which a plurality of substrates, each of which is formed with a resonator, are used to perform a signal transmission. For example, Japanese Unexamined Patent Application Publication No. 2008-67012 discloses a high-frequency signal transmission device in which a resonator is structured in each of substrates which are different from each other. Those resonators are electromagnetically coupled to each other to configure two stages of filters so as to allow a signal transmission to be established.

SUMMARY

In general, components of an electromagnetic wave radiated from an antenna in which resonators are used include a component that propagates to a far-field region around the antenna and a component that propagates only in a near-field region around the antenna. An intensity of the component propagating to the far-field region attenuates in inverse proportion to a distance "r" from the antenna, whereas an intensity of the component propagating only in the near-field region attenuates in inverse proportion to the square or the cube of the distance "r" from the antenna. On the other hand, it is advantageous to increase a bandwidth of a signal in order to achieve a high speed wireless communication. In using a signal of a broadband in order to achieve the high speed wireless communication, it is desirable that an interference of a frequency and a bandwidth with an existing wireless communication system be avoided, as may be regulated by applicable laws and regulations such as by the Radio Act of Japan. As described above, the components of the electromagnetic wave radiated from the antenna include the component propagating to the far-field region, and thus power of radiation of the antenna is desirably made small to the utmost limit so as to minimize the component propagating to the far-field region, when performing a wireless communication for a short distance of a magnitude from few millimeters to few centimeters, for example. Using weak transmission power of a level which does not violate the applicable laws and regulations eliminates limitations in the frequency and the bandwidth, and thereby makes it possible to achieve the high speed wireless communication for a short distance. It is, however, difficult for a currently-available resonator structure, such as that disclosed in Japanese Unexamined Patent Application Publication No. 2008-67012, to prevent a leakage of a signal (an electromagnetic wave) that reaches the far-field region, while achieving the high speed wireless communication for the short distance.

It is desirable to provide an antenna and a wireless communication unit, capable of preventing a leakage of signal (for example, an electromagnetic wave) reaching a far-field region.

An antenna according to an embodiment of the technology includes: a first resonator and a second resonator each having an open end, in which the first resonator and the second resonator are disposed side by side to allow the open ends thereof to be opposed to each other; and a first capacitor connected between the open ends which are opposed to each other.

A wireless communication unit according to an embodiment of the technology includes: a first antenna transmitting a signal; and a second antenna receiving the signal transmitted from the first antenna. The first antenna includes: a first resonator and a second resonator each having an open end, in which the first resonator and the second resonator are disposed side by side to allow the open ends thereof to be opposed to each other; and a capacitor connected between the open ends which are opposed to each other.

Advantageously, the second antenna includes: a first resonator and a second resonator each having an open end, in which the first resonator and the second resonator are disposed side by side to allow the open ends thereof to be opposed to each other; and a capacitor connected between the open ends which are opposed to each other, and the first antenna receiving a signal transmitted from the second antenna, the second antenna transmitting the signal to the first antenna, thereby a bidirectional communication through transmitting-receiving the signal is performed between the first antenna and the second antenna.

In the antenna and the wireless communication unit according to the embodiments of the technology, the first resonator and the second resonator are disposed side by side to allow the open ends thereof to be opposed to each other, and the mutually-opposed open ends are connected to each other through the capacitor. Thus, in a basic resonance mode (a lowest order resonance mode in which a resonance frequency is the lowest), directions of currents that flow in the first resonator and the second resonator become opposite to each other (a differential resonance mode is established). Thereby, in the basic resonance mode, the currents flowing in the first resonator and the second resonator cancel out each other, reducing power of radiation for a far distance.

Advantageously, each of the first resonator and the second resonator is a planar waveguide type resonator having a conductor line, and the first capacitor is configured with use of a pair of conductor electrode patterns each provided at each of the open ends of the first resonator and the second resonator.

Advantageously, the first capacitor is a capacitor device which is, as a discrete component, independent from the first resonator and the second resonator.

Advantageously, a second capacitor is further included, wherein the first resonator is a first half-wavelength resonator having a first open end and a second open end at both ends thereof, respectively, the second resonator is a second half-wavelength resonator having a first open end and a second open end at both ends thereof, respectively, the first capacitor is connected between the first open end of the first half-wavelength resonator and the first open end of the second half-wavelength resonator, and the second capacitor is connected between the second open end of the first half-wavelength resonator and the second open end of the second half-wavelength resonator.

Advantageously, the first half-wavelength resonator is connected, at a position, to a first end of a signal source, the position being away from a resonance center position of the first half-wavelength resonator by a predetermined distance, and the signal source being grounded at a second end thereof.

Advantageously, the first half-wavelength resonator is connected, at a position, to a first end of a signal source, the position being away from a resonance center position of the first half-wavelength resonator by a predetermined distance, and the signal source being connected to the second half-wavelength resonator at a resonance center position thereof.

Advantageously, the first resonator is a first quarter-wavelength resonator having an open end and a short-circuit end at both ends thereof, respectively, and the second resonator is a second quarter-wavelength resonator having an open end and a short-circuit end at both ends thereof, respectively.

Advantageously, the first quarter-wavelength resonator is connected, at a position, to a first end of a signal source, the position being away from the short-circuit end of the first quarter-wavelength resonator by a predetermined distance, and the signal source being grounded at a second end thereof.

As used herein, the term "signal transmission" or the like in the antenna and the wireless communication unit according to the embodiments of the technology refers not only to a signal transmission for transmitting and receiving a signal such as an analog signal and a digital signal, but also refers to a power transmission used for transmitting and receiving electric power.

According to the antenna and the wireless communication unit of the embodiments of the technology, the first resonator and the second resonator are disposed side by side to allow the open ends thereof to be opposed to each other, and the mutually-opposed open ends are connected to each other through the capacitor. Thus, the basic resonance mode is achieved in which the directions of the currents that flow in the first resonator and the second resonator become opposite to each other. Thereby, in the basic resonance mode, the currents flowing in the first resonator and the second resonator cancel out each other, reducing the power of radiation for the far distance. Hence, it is possible to prevent a leakage of a signal (for example, an electromagnetic wave) reaching a far-field region, with respect to a signal transmission at a frequency band corresponding to the basic resonance mode.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 3A describes states of an electric field distribution and a current vector of a first resonator in the basic resonance mode in the antenna illustrated in FIG. 1, and FIG. 3B describes states of an electric field distribution and a current vector of a second resonator in the basic resonance mode therein.

FIG. 4 is a configuration view illustrating a first example of an exciting method of the resonators in the antenna illustrated in FIG. 1.

DETAILED DESCRIPTION

In the following, some embodiments of the technology will be described in detail with reference to the accompanying drawings.

First Embodiment

[Basic Configuration of Antenna]

Figure 1:
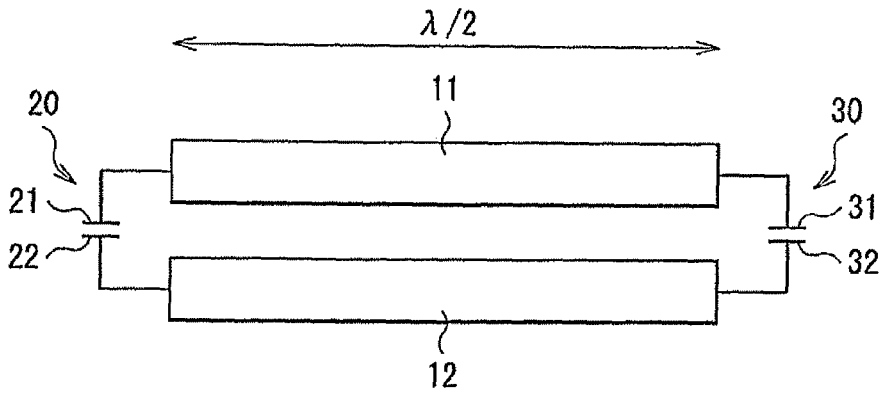
FIG. 1 is a circuit diagram illustrating a basic configuration of an antenna according to a first embodiment of the technology.

FIG. 1 illustrates a basic configuration of an antenna according to a first embodiment of the technology. The antenna is provided with a first half-wavelength resonator 11 (for example, a first resonator), a second half-wavelength resonator 12 (for example, a second resonator), a first capacitor 20, and a second capacitor 30.

Each of the first half-wavelength resonator 11 and the second half-wavelength resonator 12 has both ends each serving as an open end. The first half-wavelength resonator 11 and the second half-wavelength resonator 12 are so disposed side by side that the open ends thereof are opposed to each other. For example, the first half-wavelength resonator 11 and the second half-wavelength resonator 12 may be disposed parallel to each other in the same plane, or may be disposed parallel to each other in a vertical direction. The first capacitor 20 and the second capacitor 30 are each connected to the mutually-opposed open ends of the first half-wavelength resonator 11 and the second half-wavelength resonator 12.

More specifically, the first capacitor 20 is connected to a first open end 11*a* (i.e., one of the open ends) of the first half-wavelength resonator 11 and to a first open end 12*a* (i.e., one of the open ends) of the second half-wavelength resonator 12 that are opposed to each other. A first capacitor electrode 21 of the first capacitor 20 is connected to the first open end of the first half-wavelength resonator 11. A second capacitor electrode 22 of the first capacitor 20 is connected to the first open end of the second half-wavelength resonator 12.

Also, the second capacitor 30 is connected to a second open end 11*b* (i.e., the other open end) of the first half-wavelength resonator 11 and to a second open end 12*b* (i.e., the other open end) of the second half-wavelength resonator 12 that are opposed to each other. A first capacitor electrode 31 of the second capacitor 30 is connected to the second open end of the first half-wavelength resonator 11. A second capacitor electrode 32 of the second capacitor 30 is connected to the second open end of the second half-wavelength resonator 12.

[Basic Operation and Effect of Antenna]

Figure 2:
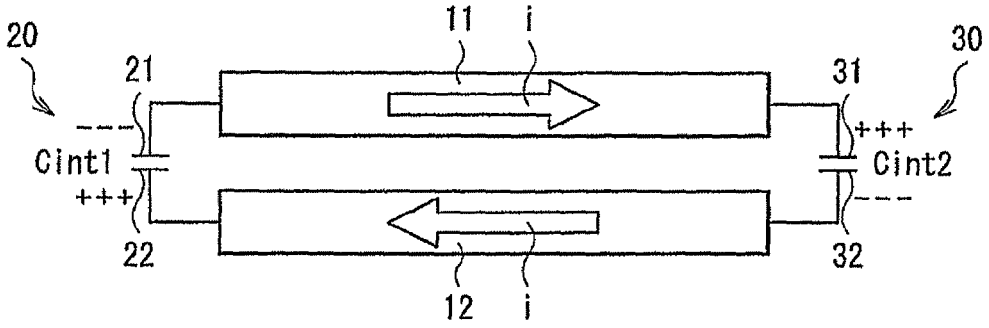
FIG. 2 describes states of a charge distribution and a current vector in a basic resonance mode in the antenna illustrated in FIG. 1.

FIG. 2 illustrates states of a charge distribution and a current vector in a basic resonance mode (a lowest order resonance mode in which a resonance frequency is the lowest) in the antenna illustrated in FIG. 1. FIG. 3A illustrates states of a distribution of an electric field E and a current vector (i) of the first half-wavelength resonator 11 in the basic resonance mode, and FIG. 3B illustrates states of the distribution of the electric field E and the current vector (i) of the second half-wavelength resonator 12 in the basic resonance mode.

In the antenna according to the first embodiment, the first half-wavelength resonator 11 and the second half-wavelength resonator 12 are so disposed side by side (for example, disposed parallel to each other) that the open ends thereof are opposed to each other, and the mutually-opposed open ends are connected to each other through the first capacitor 20 and the second capacitor 30, respectively. Thereby, such electric field intensity distributions illustrated in FIGS. 3A and 3B are established in the basic resonance mode. In other words, the electric field distributions are in opposite phase with each other for the first half-wavelength resonator 11 and the second half-wavelength resonator 12 with a physical center line 16 of the resonators being a center of resonance (a zero potential), where a capacitance Cint1 of the first capacitor 20 and a capacitance Cint2 of the second capacitor 30 are defined as the same. Thus, in the basic resonance mode, directions of the currents "i" that flow in the first half-wavelength resonator 11 and the second half-wavelength resonator 12 are opposite to each other as illustrated in FIG. 2 for the first half-wavelength resonator 11 and the second half-wavelength resonator 12 (a differential resonance mode is established). Thereby, the currents flowing in the first half-wavelength resonator 11 and the second half-wavelength resonator 12 cancel out each other for the first half-wavelength resonator 11 and the second half-wavelength resonator 12, reducing power of radiation for a far distance in the basic resonance mode. Hence, this makes it possible to prevent a leakage of a signal (for example, an electromagnetic wave) reaching a far-field region, with respect to a signal transmission at a frequency band corresponding to the basic resonance mode.

In general, components of an electromagnetic wave radiated from an antenna in which resonators are used include a component that propagates to a far-field region around the antenna and a component that propagates only in a near-field region around the antenna. The component propagating to the far-field region is radiated to outside as energy and does not return to an input resonator, which thus causes a loss (for example, a radiation loss). On the other hand, energy of the component propagating only in the near-field region is stored as reactance energy in space near the resonator without being radiated to the outside. Thus, even when power of radiation of the component propagating to the far-field region is zero, bringing two antennas close to each other allows respective resonators structuring those two antennas to electromagnetically couple to one another to establish a reactance coupling, by virtue of the component propagating only in the near-field region. In this case, an exchange of energy, attributed to the component propagating only in the near-field region, starts between the respective resonators structuring the two antennas, by which a resonance state is established to form a hybrid resonance mode, making it possible to perform a signal transmission between the resonators which are different from each other (i.e., between the two antennas). Thus, using the two antennas each having the configuration illustrated in FIG. 1 and bringing those antennas close to each other make it possible to achieve the wireless communication unit in which a transmission is performed only with (or only substantially with) the reactance coupling while minimizing the power of radiation to the utmost level, where the antenna illustrated in FIG. 1 is regarded as a coupler, for example. Hence, it is possible to achieve a high speed wireless communication for a short distance, while avoiding an interference of a frequency and a bandwidth with an existing wireless communication system.

[Method of Establishing Connection with Signal Source (Exciting Method of Resonators)]

FIG. 4 illustrates a first example of an exciting method of the resonators in the antenna illustrated in FIG. 1. In the first example, one end or a "first end" (for example, a first connection line 15) of a signal source 13 is connected to the first half-wavelength resonator 11 at a position 17 which is separated away from a resonance center position thereof by a predetermined distance x0, and the other end or a "second end" (for example, a second connection line 14) of the signal source 13 is grounded. It is to be noted here that the physical center line 16 of the resonators is the center of resonance (the zero potential) where the capacitance Cint1 of the first capacitor 20 and the capacitance Cint2 of the second capacitor 30 are defined as the same. In this case, the first end of the signal source 13 is connected at the position 17 which is separated away from the center line 16 by the distance x0.

Figure 5:
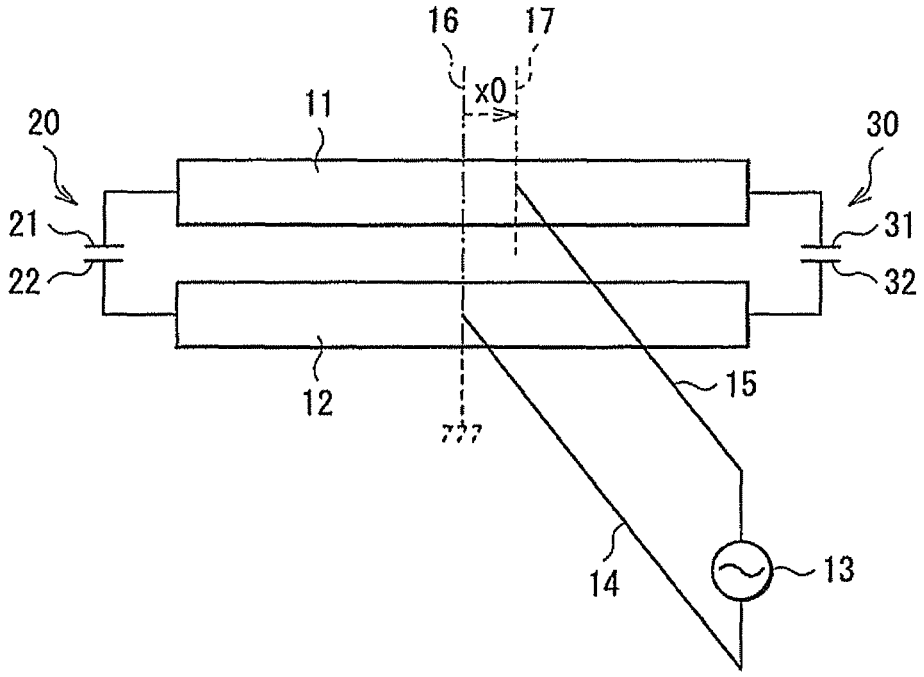
FIG. 5 is a configuration view illustrating a second example of the exciting method of the resonators in the antenna illustrated in FIG. 1.

FIG. 5 illustrates a second example of the exciting method of the resonators. In the second example, the first end (for example, the first connection line 15) of the signal source 13 is connected to the first half-wavelength resonator 11 at the position 17 which is separated away from the resonance center position thereof by the predetermined distance x0, and the second end (for example, the second connection line 14) of the signal source 13 is connected to the second half-wavelength resonator 12 at the resonance center position thereof. It is to be noted here that the physical center line 16 of the resonators is the center of resonance (the zero potential) where the capacitance Cint1 of the first capacitor 20 and the capacitance Cint2 of the second capacitor 30 are defined as the same. In this case, the first end of the signal source 13 is connected at the position 17 which is separated away from the center line 16 by the distance x0, and the second end of the signal source 13 is connected at a position of the center line 16.

The distance x0 in FIGS. 4 and 5 is set to a value by which the first half-wavelength resonator 11 and the signal source 13 are matched (for example, an impedance matching is established). That is, the shorter the distance x0, the smaller the coupling between the first half-wavelength resonator 11 and the signal source 13.

[Concrete Configuration Example of Antenna]

Figure 6A:
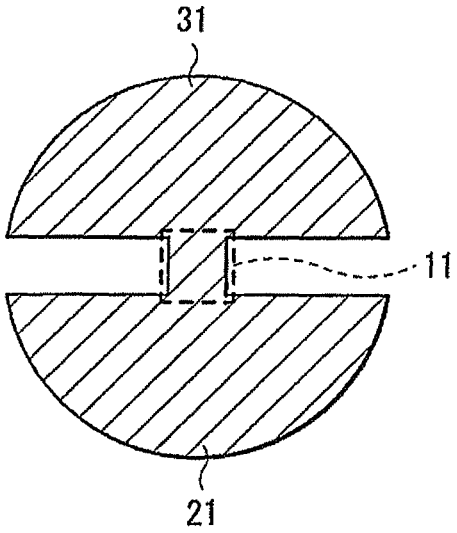
FIGS. 6A and 6B are plan views each illustrating a concrete configuration example of the antenna illustrated in FIG. 1.
Figure 6B:
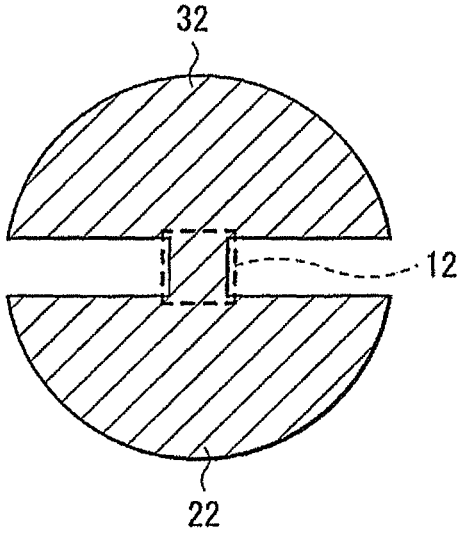

FIGS. 6A and 6B are plan views each illustrating a concrete (but not limitative) configuration example of the antenna illustrated in FIG. 1. For example, conductors having such patterns illustrated in FIGS. 6A and 6B may be formed on mutually-opposed two faces of a flat-plate-like dielectric substrate, respectively. The conductor pattern illustrated in FIG. 6A may be formed on a top face of the dielectric substrate, and the conductor pattern illustrated in FIG. 6B may be formed on a bottom face thereof, for example. The conductor pattern illustrated in FIG. 6A includes: a first conductor line pattern located at the center thereof and structuring the first half-wavelength resonator 11; and, at both ends (open ends) of the first conductor line pattern, an electrode pattern of the first capacitor electrode 21 for the first capacitor 20 and an electrode pattern of the first capacitor electrode 31 for the second capacitor 30, each of which is formed in a semicircular shape. The conductor pattern illustrated in FIG. 6B also has a configuration similar to that of the conductor pattern illustrated in FIG. 6A. Namely, the conductor pattern illustrated in FIG. 6B includes: a second conductor line pattern located at the center thereof and structuring the second half-wavelength resonator 12; and, at both ends (open ends) of the second conductor line pattern, an electrode pattern of the second capacitor electrode 22 for the first capacitor 20 and an electrode pattern of the second capacitor electrode 32 for the second capacitor 30, each of which is formed in a semicircular shape. In one embodiment, each of the first half-wavelength resonator 11 and the second half-wavelength resonator 12 is a planar waveguide type resonator. Examples of the planar waveguide type resonator include such as a microstrip line type resonator, an embedded microstrip line type resonator, a coplanar waveguide type resonator, and other suitable line resonators, although it is not limited thereto.

Figure 7:
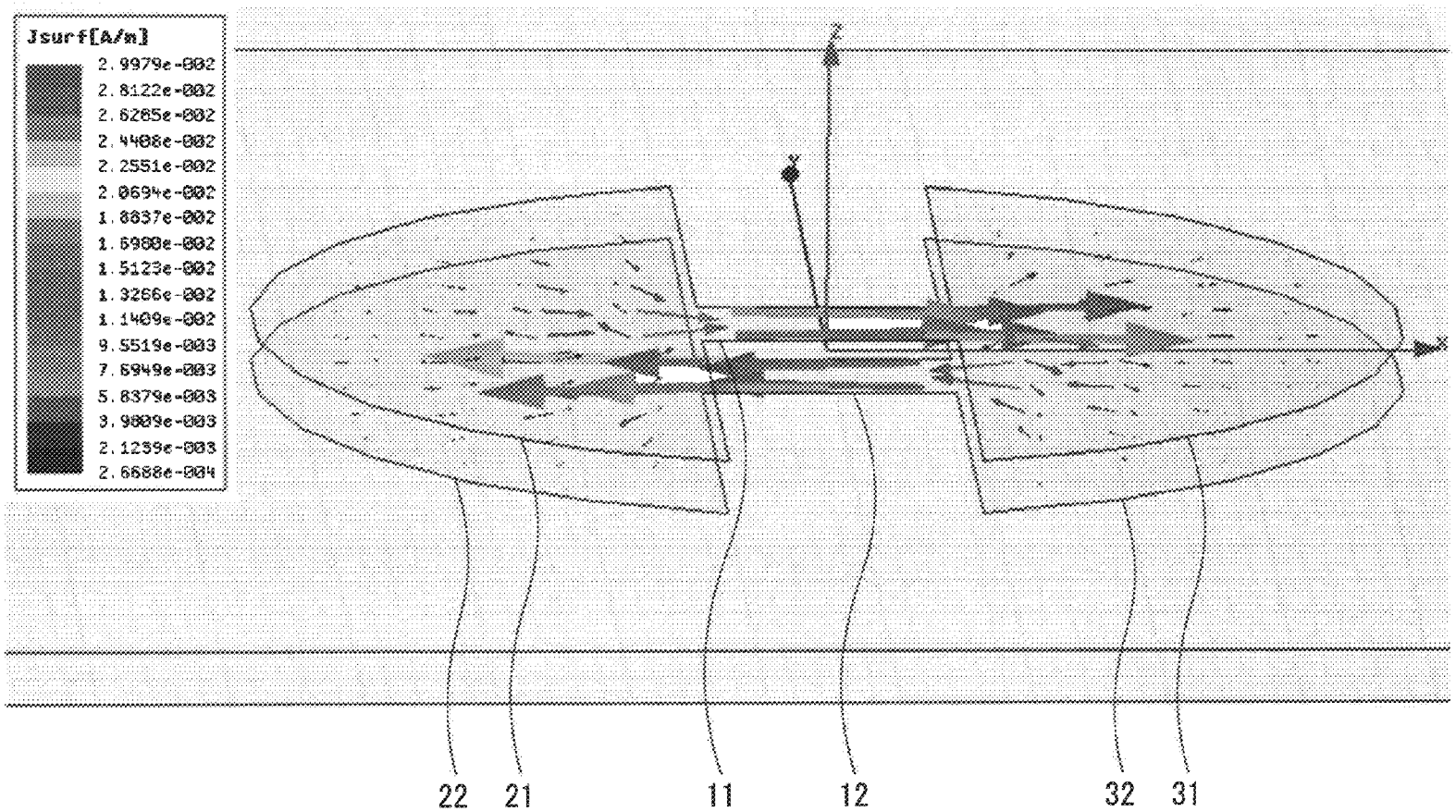
FIG. 7 is a characteristic diagram illustrating a result of a simulation of the state of the current vector in the basic resonance mode in the concrete configuration example illustrated in FIGS. 6A and 6B.

FIG. 7 represents a result of a simulation of a state of a current vector in the basic resonance mode in the concrete configuration example illustrated in FIGS. 6A and 6B. It can be seen from FIG. 7 that the directions of the currents that flow in the first half-wavelength resonator 11 and the second half-wavelength resonator 12 are opposite to each other for the first half-wavelength resonator 11 and the second half-wavelength resonator 12.

[Configuration Example of Wireless Communication Unit]

In constructing a wireless communication system, it is preferable that at least an antenna used for transmission be structured by the antenna illustrated in FIG. 1, in order to prevent a leakage of an electromagnetic wave that reaches the far-field region. When performing a bidirectional communication between two antennas, each of those two antennas is preferably structured by the antenna illustrated in FIG. 1. In the following, an example of the wireless communication unit is described in which the two antennas having substantially the same configuration are used.

Figure 8:
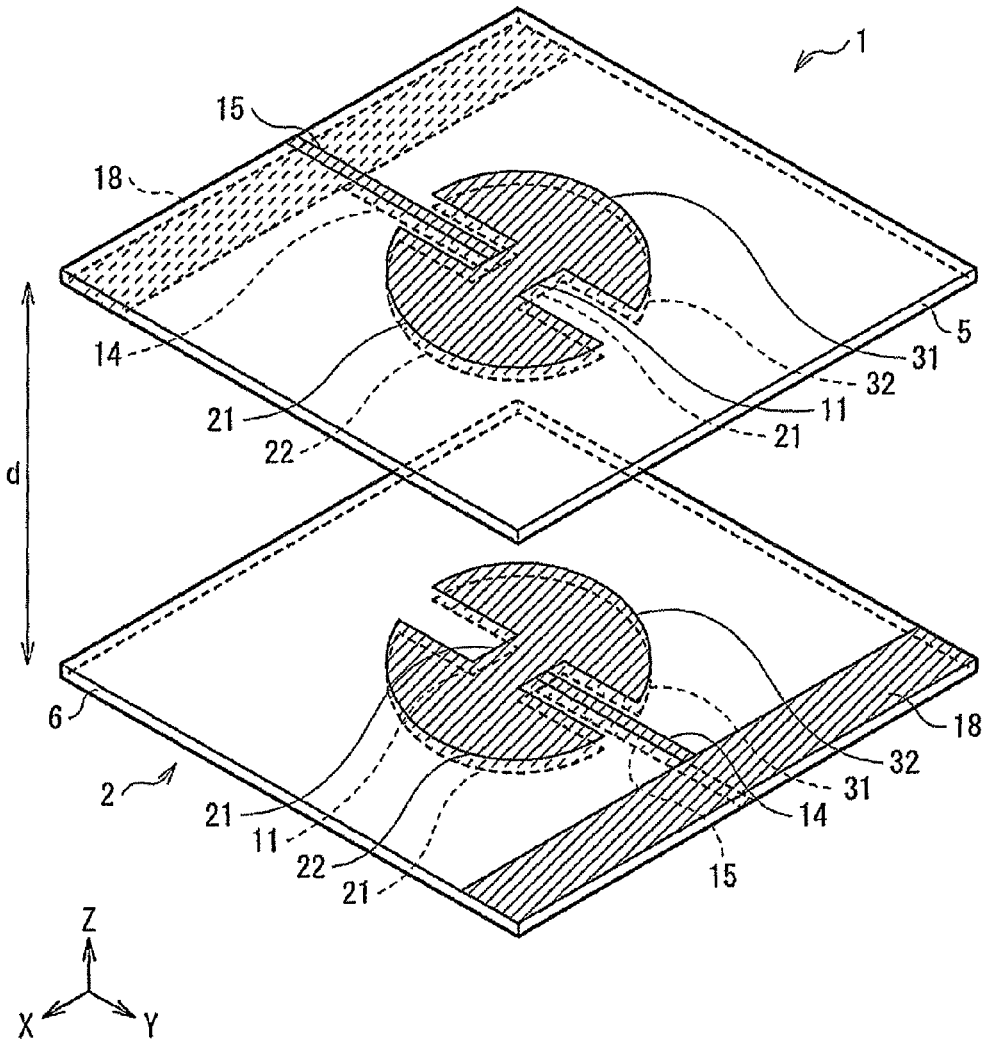
FIG. 8 is a perspective view illustrating an example of a wireless communication unit that uses the antenna illustrated in FIG. 1.

FIG. 8 illustrates an example of the wireless communication unit that utilizes the antenna illustrated in FIG. 1. The wireless communication unit is provided with a first antenna 1, and a second antenna 2. The first antenna 1 has a first dielectric substrate 5 that may have a flat-plate-like shape. The second antenna 2 has a second dielectric substrate 6 that may have a flat-plate-like shape. In performing a communication, the first dielectric substrate 5 and the second dielectric substrate 6 are disposed to oppose each other with a spacing "d" in between. The spacing "d" may be in a range from few millimeters to few centimeters, for example.

Figure 9A:
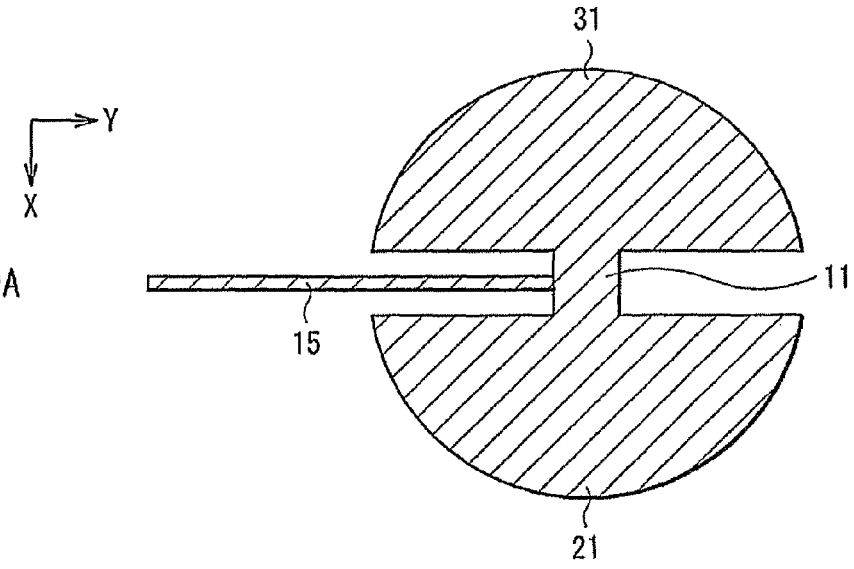
FIGS. 9A and 9B are plan views each illustrating a structure of a conductor pattern in the wireless communication unit illustrated in FIG. 8.
Figure 9B:
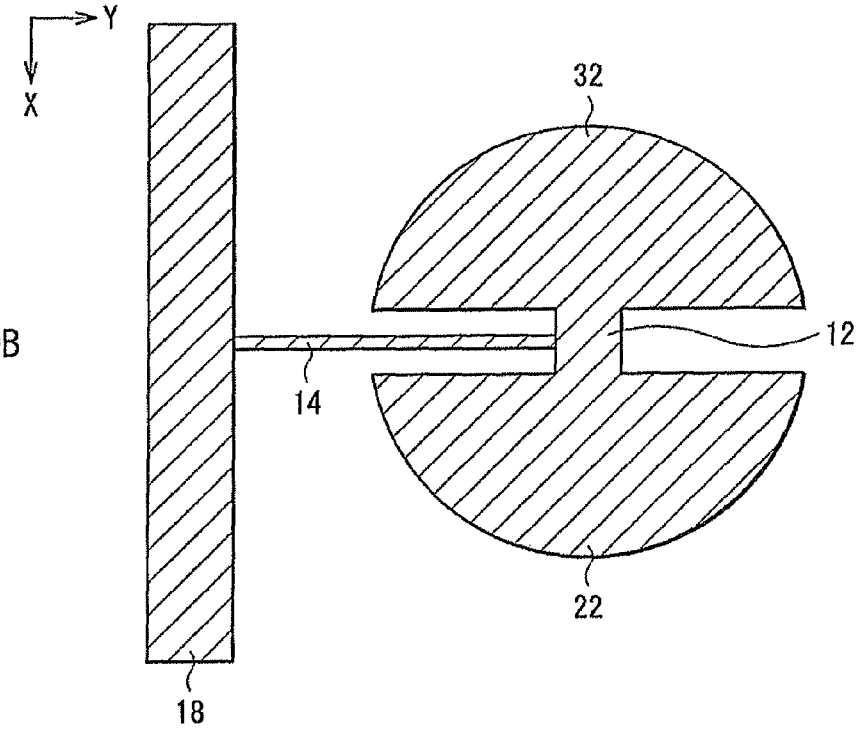

A first face (for example, a top face) and a second face (for example, a bottom face) of the first dielectric substrate 5 that are opposed to each other are formed with conductors having such patterns illustrated in FIGS. 9A and 9B. Similarly, a first face (for example, a top face) and a second face (for example, a bottom face) of the second dielectric substrate 6 that are opposed to each other are formed with the conductors having such patterns illustrated in FIGS. 9A and 9B. More specifically, the top face of the first dielectric substrate 5 is formed with the conductor pattern illustrated in FIG. 9A, and the bottom face thereof is formed with the conductor pattern illustrated in FIG. 9B. Similarly, the top face of the second dielectric substrate 6 is formed with the conductor pattern illustrated in FIG. 9B, and the bottom face thereof is formed with the conductor pattern illustrated in FIG. 9A.

As with the conductor pattern illustrated in FIG. 6A, the conductor pattern illustrated in FIG. 9A includes: the first conductor line pattern located at the center thereof and structuring the first half-wavelength resonator 11; and, at both ends (open ends) of the first conductor line pattern, the electrode pattern of the first capacitor electrode 21 for the first capacitor 20 and the electrode pattern of the first capacitor electrode 31 for the second capacitor 30, each of which is formed in a semicircular shape. The conductor pattern of FIG. 9A is further formed with a line pattern serving as the first connection line 15 by which, for example, the first end of the signal source 13 (see FIG. 4) may be connected. A first end (one end) of the line pattern serving as the first connection line 15 is connected to the first conductor line pattern at the center. As described above, it is preferable that the first end of the line pattern serving as the first connection line 15 be connected to the first conductor line pattern structuring the first half-wavelength resonator 11 at a position which is separated away from a center position thereof by a predetermined distance x0, such that the impedance matching is established between the first half-wavelength resonator 11 and the signal source 13.

As with the conductor pattern illustrated in FIG. 6B, the conductor pattern illustrated in FIG. 9B includes: the second conductor line pattern located at the center thereof and structuring the second half-wavelength resonator 12; and, at both ends (open ends) of the second conductor line pattern, the electrode pattern of the second capacitor electrode 22 for the first capacitor 20 and the electrode pattern of the second capacitor electrode 32 for the second capacitor 30, each of which is formed in a semicircular shape. The conductor pattern of FIG. 9B is further formed with: a line pattern serving as the second connection line 14 by which, for example, the second end of the signal source 13 (see FIG. 4) may be connected; and an electrode pattern serving as a ground electrode 18. A first end (one end) of the line pattern serving as the second connection line 14 is connected to the second conductor line pattern at the center. It is preferable that the first end of the line pattern serving as the second connection line 14 be connected to the second conductor line pattern structuring the second half-wavelength resonator 12 at a center position thereof.

The wireless communication unit may allow the first antenna 1 to operate as a transmission antenna, and may allow the second antenna 2 to operate as a receiving antenna which performs a reception of a signal transmitted from the first antenna 1. Also, each of the first antenna 1 and the second antenna 2 may be used as a transmitting-receiving antenna to perform transmission and reception of a signal in a bidirectional fashion between the first antenna 1 and the second antenna 2.

[Modifications of Concrete Configuration of Antenna]

Figure 10:
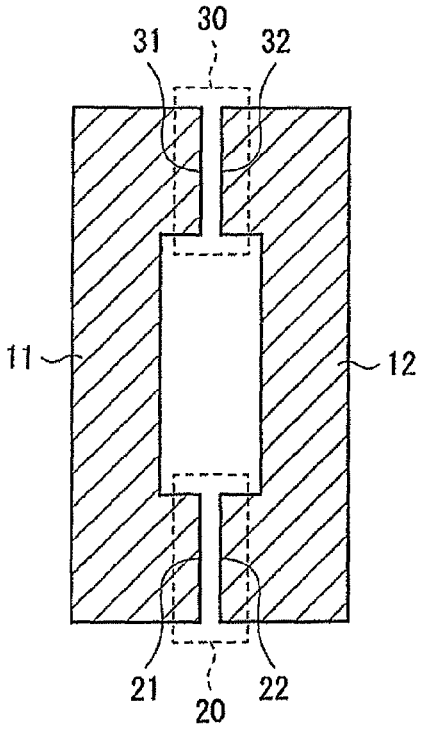
FIG. 10 is a plan view illustrating a first modification of the concrete configuration of the antenna illustrated in FIG. 1.

FIG. 10 illustrates a first modification of the concrete configuration of the antenna illustrated in FIG. 1. The first modification has a configuration in which conductors having such patterns illustrated in FIG. 10 are formed within a single plane of a dielectric substrate which may be in a flat-plate-like shape. As illustrated in FIG. 10, the first conductor line pattern structuring the first half-wavelength resonator 11 and the second conductor line pattern structuring the second half-wavelength resonator 12 are formed side by side within the same plane. Portions of both ends (open ends) of the first conductor line pattern that are opposed to the second conductor line pattern are formed with the electrode pattern of the first capacitor electrode 21 for the first capacitor 20 and the electrode pattern of the first capacitor electrode 31 for the second capacitor 30, respectively. Those electrode patterns are each formed to have a step relative to the first conductor line pattern. Portions of both ends (open ends) of the second conductor line pattern structuring the second half-wavelength resonator 12 that are opposed to the first conductor line pattern are formed with the electrode pattern of the second capacitor electrode 22 for the first capacitor 20 and the electrode pattern of the second capacitor electrode 32 for the second capacitor 30, respectively. Those electrode patterns are each formed to have a step relative to the second conductor line pattern.

In the configuration example illustrated in FIG. 10, the electrode pattern of the first capacitor electrode 21 and the electrode pattern of the second capacitor electrode 22 are opposed to each other with a predetermined spacing in between within the same plane to thereby form the first capacitor 20. Also, the electrode pattern of the first capacitor electrode 31 and the electrode pattern of the second capacitor electrode 32 are opposed to each other with the predetermined spacing in between within the same plane to thereby form the second capacitor 30.

Figure 11:
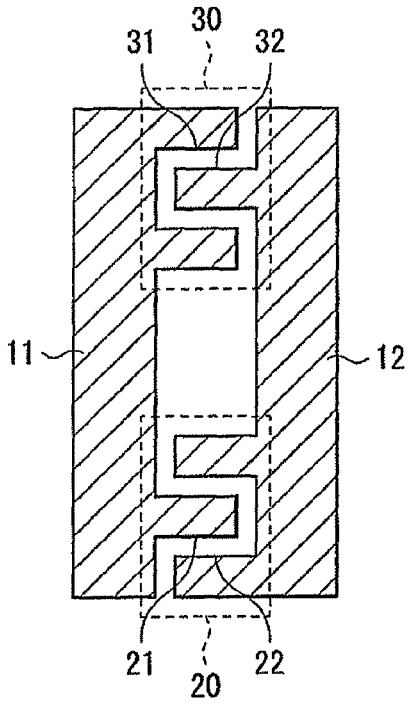
FIG. 11 is a plan view illustrating a second modification of the concrete configuration of the antenna illustrated in FIG. 1.

FIG. 11 illustrates a second modification. As in the configuration example illustrated in FIG. 10, the second modification has a configuration in which conductors having such patterns illustrated in FIG. 11 are formed within a single plane of a dielectric substrate which may be in a flat-plate-like shape. The configuration of the second modification is basically similar to that of the configuration example illustrated in FIG. 10, except that shapes of electrode patterns structuring the first capacitor 20 and the second capacitor 30 differ therefrom. In the second modification, the electrode pattern of the first capacitor electrode 21 and the electrode pattern of the second capacitor electrode 22 are each formed to have a comb-like shape, and line portions thereof forming the comb-like shape are opposed to each other alternately with a predetermined spacing in between to thereby form the first capacitor 20 having an interdigital line structure. Similarly, the electrode pattern of the first capacitor electrode 31 and the electrode pattern of the second capacitor electrode 32 are each formed to have the comb-like shape, and line portions thereof forming the comb-like shape are opposed to each other alternately with the predetermined spacing in between to thereby form the second capacitor 30 having a line structure of an interdigital type. The second modification allows the electrode patterns structuring the first capacitor 20 and the second capacitor 30 to have the interdigital line structure, making it possible to increase opposing capacitance, and thereby to form larger capacitance, and to achieve reduction of size of the antenna as a whole.

Figure 12:
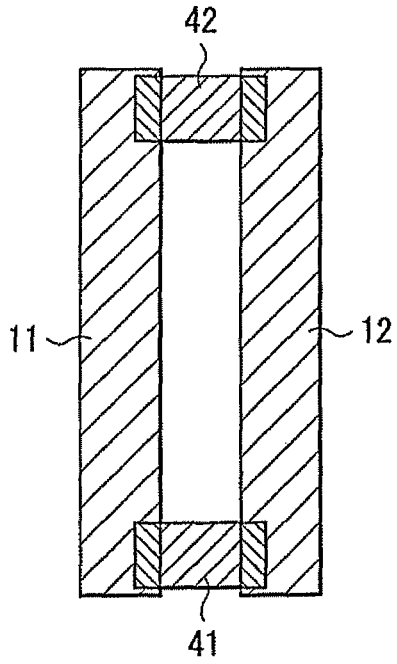
FIG. 12 is a plan view illustrating a third modification of the concrete configuration of the antenna illustrated in FIG. 1.

FIG. 12 illustrates a third modification. As in the configuration example illustrated in FIG. 10, the third modification has a configuration in which the first conductor line pattern structuring the first half-wavelength resonator 11 and the second conductor line pattern structuring the second half-wavelength resonator 12 are formed side by side within a single plane of the dielectric substrate which may be in the flat-plate-like shape. The third modification differs from the configuration example illustrated in FIG. 10, in that the first capacitor 20 and the second capacitor 30 are capacitor devices that are, as discrete components, independent from the first half-wavelength resonator 11 and the second half-wavelength resonator 12, without configuring the first capacitor 20 and the second capacitor 30 by the electrode patterns of the conductors. More specifically, a first chip capacitor 41 serving as the first capacitor 20 is connected to the first open end of the first half-wavelength resonator 11 (for example, the first conductor line pattern) and to the first open end of the second half-wavelength resonator 12 (for example, the second conductor line pattern) that are opposed to each other. Also, a second chip capacitor 42 serving as the second capacitor 30 is connected to the second open end of the first half-wavelength resonator 11 (for example, the first conductor line pattern) and to the second open end of the second half-wavelength resonator 12 (for example, the second conductor line pattern) that are opposed to each other. The third modification configures the first capacitor 20 and the second capacitor 30 with the capacitor devices rather than the electrode patterns of the conductors, making it possible to form larger capacitance than the configuration example illustrated in FIG. 10, for example, and to achieve reduction of size of the antenna as a whole.

Figure 13A:
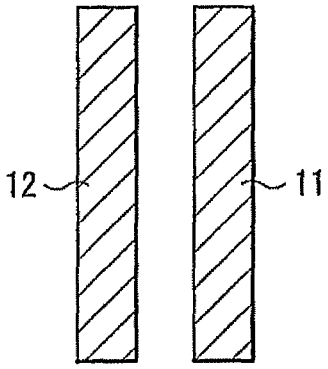
FIGS. 13A to 13C are plan views each illustrating a fourth modification of the concrete configuration of the antenna illustrated in FIG. 1.
Figure 13B:
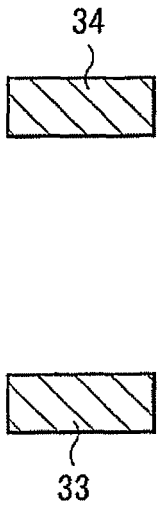
Figure 13C:
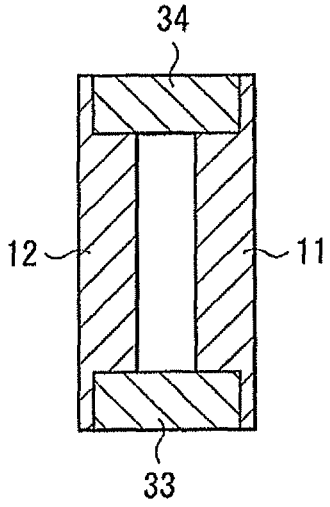

FIGS. 13A to 13C each illustrate a fourth modification. In this modification, for example, conductors having such patterns illustrated in FIGS. 13A and 13B are formed on mutually-opposed two faces of the dielectric substrate which may be in the flat-plate-like shape, respectively. FIG. 13C illustrates a state where the conductor patterns illustrated in FIGS. 13A and 13B are overlapped (caused to oppose each other). For example, the conductor pattern of FIG. 13B may be formed on a top face of the dielectric substrate, whereas the conductor pattern of FIG. 13A may be formed on a bottom face thereof. The first conductor line pattern structuring the first half-wavelength resonator 11 and the second conductor line pattern structuring the second half-wavelength resonator 12 are formed side by side to provide the electrode pattern illustrated in FIG. 13A. The electrode pattern of the first capacitor electrode 33 is formed at a position corresponding to locations of the mutually-opposed first open end of the first half-wavelength resonator 11 (for example, the first conductor line pattern) and the first open end of the second half-wavelength resonator 12 (for example, the second conductor line pattern). This thereby forms the first capacitor 20 between the mutually-opposed two faces of the dielectric substrate. Also, the electrode pattern of the second capacitor electrode 34 is formed at a position corresponding to locations of the mutually-opposed second open end of the first half-wavelength resonator 11 (for example, the first conductor line pattern) and the second open end of the second half-wavelength resonator 12 (for example, the second conductor line pattern). This thereby forms the second capacitor 30 between the mutually-opposed two faces of the dielectric substrate. The fourth modification forms capacitance between the two faces that are opposed to each other, making it possible to form larger capacitance than, for example, the configuration example illustrated in FIG. 10 in which the capacitors are formed within the single plane, and to achieve reduction of size of the antenna as a whole.

Figure 14A:
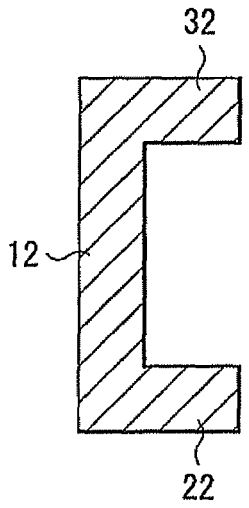
FIGS. 14A to 14C are plan views each illustrating a fifth modification of the concrete configuration of the antenna illustrated in FIG. 1.
Figure 14B:
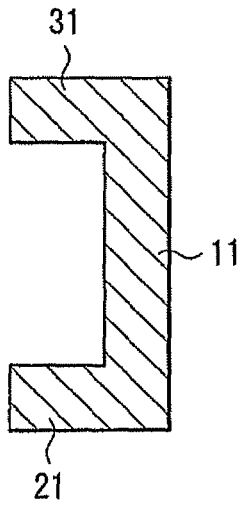
Figure 14C:
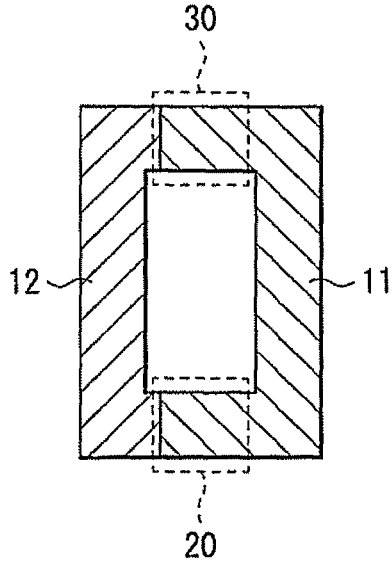

FIGS. 14A to 14C each illustrate a fifth modification. In this modification, for example, conductors having such patterns illustrated in FIGS. 14A and 14B are formed on mutually-opposed two faces of the dielectric substrate which may be in the flat-plate-like shape, respectively. FIG. 14C illustrates a state where the conductor patterns illustrated in FIGS. 14A and 14B are overlapped (caused to oppose each other). For example, the conductor pattern of FIG. 14B may be formed on a top face of the dielectric substrate, whereas the conductor pattern of FIG. 14A may be formed on a bottom face thereof. The electrode pattern illustrated in FIG. 14A includes: the second conductor line pattern structuring the second half-wavelength resonator 12; and the electrode pattern of the second capacitor electrode 22 for the first capacitor 20 and the electrode pattern of the second capacitor electrode 32 for the second capacitor 30 formed on portions of both ends (open ends) of the second conductor line pattern, respectively. The second conductor line pattern as well as the electrode pattern of the second capacitor electrode 22 and the electrode pattern of the second capacitor electrode 32 form a letter "C"-like shape as a whole to provide the electrode pattern illustrated in FIG. 14A. The electrode pattern illustrated in FIG. 14B includes: the first conductor line pattern structuring the first half-wavelength resonator 11; and the electrode pattern of the first capacitor electrode 21 for the first capacitor 20 and the electrode pattern of the first capacitor electrode 31 for the second capacitor 30 formed on portions of both ends (open ends) of the first conductor line pattern, respectively. The first conductor line pattern as well as the electrode pattern of the first capacitor electrode 21 and the electrode pattern of the first capacitor electrode 31 form a letter "C"-like shape, which has a bilateral symmetric relationship to the conductor patterns of FIG. 14A, as a whole to provide the electrode pattern illustrated in FIG. 14B. The fifth modification forms capacitance between the two faces that are opposed to each other, making it possible to form larger capacitance than, for example, the configuration example illustrated in FIG. 10 in which the capacitors are formed within the single plane, and to achieve reduction of size of the antenna as a whole.

Figure 15A:
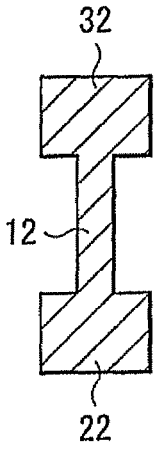
FIGS. 15A to 15C are plan views each illustrating a sixth modification of the concrete configuration of the antenna illustrated in FIG. 1.
Figure 15B:
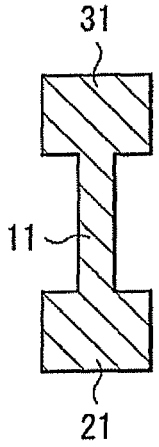
Figure 15C:
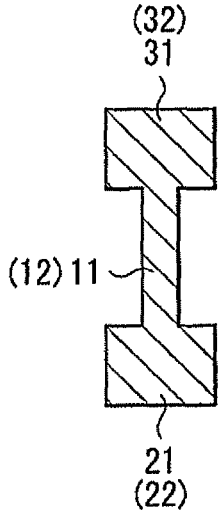

FIGS. 15A to 15C each illustrate a sixth modification. In this modification, for example, conductors having such patterns illustrated in FIGS. 15A and 15B are formed on mutually-opposed two faces of the dielectric substrate which may be in the flat-plate-like shape, respectively. FIG. 15C illustrates a state where the conductor patterns illustrated in FIGS. 15A and 15B are overlapped (caused to oppose each other). For example, the conductor pattern of FIG. 15B may be formed on a top face of the dielectric substrate, whereas the conductor pattern of FIG. 15A may be formed on a bottom face thereof. The electrode pattern illustrated in FIG. 15A includes: the second conductor line pattern structuring the second half-wavelength resonator 12; and the electrode pattern of the second capacitor electrode 22 for the first capacitor 20 and the electrode pattern of the second capacitor electrode 32 for the second capacitor 30 formed on portions of both ends (open ends) of the second conductor line pattern, respectively. The second conductor line pattern as well as the electrode pattern of the second capacitor electrode 22 and the electrode pattern of the second capacitor electrode 32 form a letter "I"-like shape as a whole to provide the electrode pattern illustrated in FIG. 15A. The electrode pattern illustrated in FIG. 15B includes: the first conductor line pattern structuring the first half-wavelength resonator 11; and the electrode pattern of the first capacitor electrode 21 for the first capacitor 20 and the electrode pattern of the first capacitor electrode 31 for the second capacitor 30 formed on portions of both ends (open ends) of the first conductor line pattern, respectively. The first conductor line pattern as well as the electrode pattern of the first capacitor electrode 21 and the electrode pattern of the first capacitor electrode 31 form a letter "I"-like shape as a whole to provide the electrode pattern illustrated in FIG. 15B. The sixth modification forms capacitance between the two faces that are opposed to each other, making it possible to form larger capacitance than, for example, the configuration example illustrated in FIG. 10 in which the capacitors are formed within the single plane, and to achieve reduction of size of the antenna as a whole.

Figure 16A:
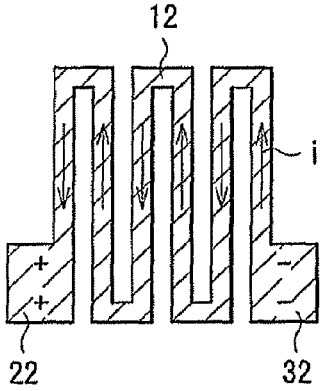
FIGS. 16A to 16C are plan views each illustrating a seventh modification of the concrete configuration of the antenna illustrated in FIG. 1.
Figure 16B:
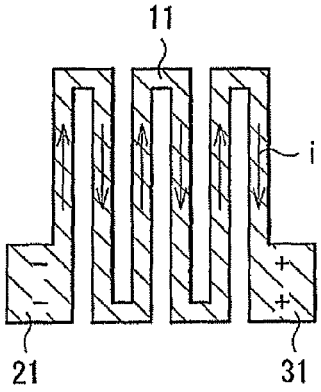
Figure 16C:
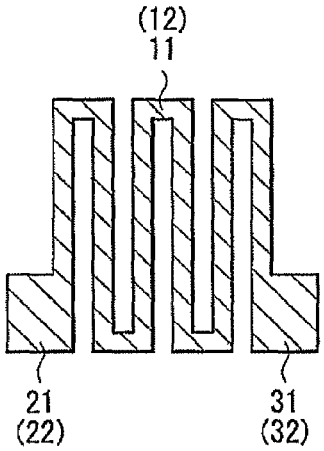

FIGS. 16A to 16C each illustrate a seventh modification. In this modification, for example, conductors having such patterns illustrated in FIGS. 16A and 16B are formed on mutually-opposed two faces of the dielectric substrate which may be in the flat-plate-like shape, respectively. FIG. 16C illustrates a state where the conductor patterns illustrated in FIGS. 16A and 16B are overlapped (caused to oppose each other). For example, the conductor pattern of FIG. 16B may be formed on a top face of the dielectric substrate, whereas the conductor pattern of FIG. 16A may be formed on a bottom face thereof. The electrode pattern illustrated in FIG. 16A includes: the second conductor line pattern having a meander structure and structuring the second half-wavelength resonator 12; and the electrode pattern of the second capacitor electrode 22 for the first capacitor 20 and the electrode pattern of the second capacitor electrode 32 for the second capacitor 30 formed on portions of both ends (open ends) of the second conductor line pattern having the meander structure, respectively. The second conductor line pattern having the meander structure as well as the electrode pattern of the second capacitor electrode 22 and the electrode pattern of the second capacitor electrode 32 provide the electrode pattern illustrated in FIG. 16A. The electrode pattern illustrated in FIG. 16B includes: the first conductor line pattern having the meander structure and structuring the first half-wavelength resonator 11; and the electrode pattern of the first capacitor electrode 21 for the first capacitor 20 and the electrode pattern of the first capacitor electrode 31 for the second capacitor 30 formed on portions of both ends (open ends) of the first conductor line pattern having the meander structure, respectively. The first conductor line pattern having the meander structure as well as the electrode pattern of the first capacitor electrode 21 and the electrode pattern of the first capacitor electrode 31 provide the electrode pattern illustrated in FIG. 16B. The seventh modification forms capacitance between the two faces that are opposed to each other, making it possible to form larger capacitance than, for example, the configuration example illustrated in FIG. 10 in which the capacitors are formed within the single plane, and to achieve reduction of size of the antenna as a whole. Also, according to the seventh modification, the first conductor line pattern and the second conductor line pattern each have the meander structure. Thus, not only does the direction of the current "i" that flows in the first half-wavelength resonator 11 become opposite to that of the current "i" that flows in the second half-wavelength resonator 12, but directions of the currents "i" that flow in each of the first half-wavelength resonator 11 and the second half-wavelength resonator 12 also become opposite to one another. This allows the currents "i" flowing in the first half-wavelength resonator 11 and the second half-wavelength resonator 12 to cancel out more effectively as compared with the embodiments where each of the first half-wavelength resonator 11 and the second half-wavelength resonator 12 is simply in a linear shape, making it possible to further reduce power of radiation for a far distance.

Figure 17A:
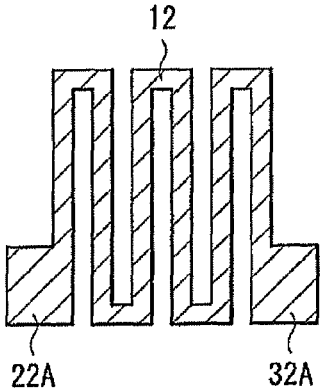
FIGS. 17A to 17C are plan views each illustrating an eighth modification of the concrete configuration of the antenna illustrated in FIG. 1.
Figure 17B:
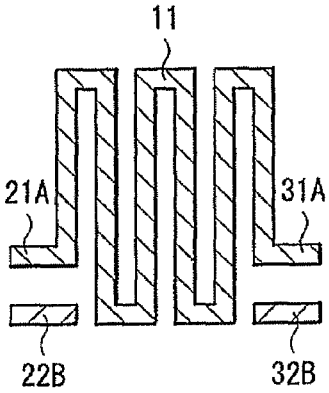
Figure 17C:
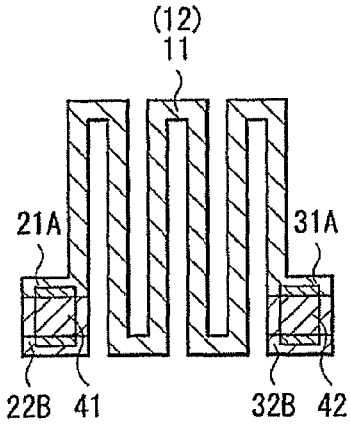

FIGS. 17A to 17C each illustrate an eighth modification. In this modification, for example, conductors having such patterns illustrated in FIGS. 17A and 17B are formed on mutually-opposed two faces of the dielectric substrate which may be in the flat-plate-like shape, respectively. FIG. 17C illustrates a state where the conductor patterns illustrated in FIGS. 17A and 17B are overlapped (caused to oppose each other). For example, the conductor pattern of FIG. 17B may be formed on a top face of the dielectric substrate, whereas the conductor pattern of FIG. 17A may be formed on a bottom face thereof. In the eighth modification, the first conductor line pattern structuring the first half-wavelength resonator 11 and the second conductor line pattern structuring the second half-wavelength resonator 12 each have the meander structure as in the seventh modification described above.

The eighth modification differs from the seventh modification described above, in that the first capacitor 20 and the second capacitor 30 are capacitor devices that are, as discrete components, independent from the first half-wavelength resonator 11 and the second half-wavelength resonator 12, without configuring the first capacitor 20 and the second capacitor 30 by the electrode patterns of the conductors. More specifically, the first chip capacitor 41 serving as the first capacitor 20 is connected to the first open end (for example, a first end 21A of the first conductor line pattern) of the first half-wavelength resonator 11 and to the first open end (for example, a first end 22A of the second conductor line pattern) of the second half-wavelength resonator 12. The first end 22A of the second conductor line pattern is connected to the first chip capacitor 41 through a first connection conductor 22B that penetrates the dielectric substrate. Also, the second chip capacitor 42 serving as the second capacitor 30 is connected to the second open end (for example, a second end 31A of the first conductor line pattern) of the first half-wavelength resonator 11 and to the second open end (for example, a second end 32A of the second conductor line pattern) of the second half-wavelength resonator 12. The second end 32A of the second conductor line pattern is connected to the second chip capacitor 42 through a second connection conductor 32B that penetrates the dielectric substrate. The eighth modification configures the first capacitor 20 and the second capacitor 30 with the capacitor devices rather than the electrode patterns of the conductors, making it possible to form larger capacitance with smaller area than, for example, the seventh modification described above.

Figure 18A:
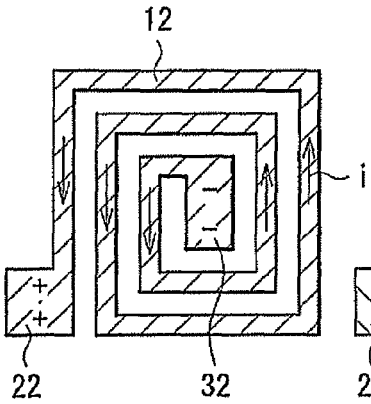
FIGS. 18A to 18C are plan views each illustrating a ninth modification of the concrete configuration of the antenna illustrated in FIG. 1.
Figure 18B:
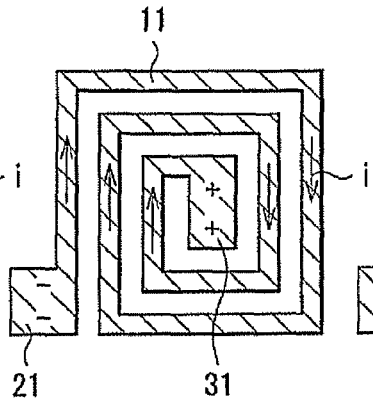
Figure 18C:
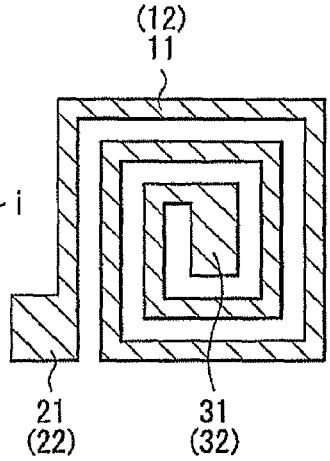

FIGS. 18A to 18C each illustrate a ninth modification. In this modification, for example, conductors having such patterns illustrated in FIGS. 18A and 18B are formed on mutually-opposed two faces of the dielectric substrate which may be in the flat-plate-like shape, respectively. FIG. 18C illustrates a state where the conductor patterns illustrated in FIGS. 18A and 18B are overlapped (caused to oppose each other). For example, the conductor pattern of FIG. 18B may be formed on a top face of the dielectric substrate, whereas the conductor pattern of FIG. 18A may be formed on a bottom face thereof. The electrode pattern illustrated in FIG. 18A includes: the second conductor line pattern having a spiral structure and structuring the second half-wavelength resonator 12; and the electrode pattern of the second capacitor electrode 22 for the first capacitor 20 and the electrode pattern of the second capacitor electrode 32 for the second capacitor 30 formed on portions of both ends (open ends) of the second conductor line pattern having the spiral structure, respectively. The second conductor line pattern having the spiral structure as well as the electrode pattern of the second capacitor electrode 22 and the electrode pattern of the second capacitor electrode 32 provide the electrode pattern illustrated in FIG. 18A. The electrode pattern illustrated in FIG. 18B includes: the first conductor line pattern having the spiral structure and structuring the first half-wavelength resonator 11; and the electrode pattern of the first capacitor electrode 21 for the first capacitor 20 and the electrode pattern of the first capacitor electrode 31 for the second capacitor 30 formed on portions of both ends (open ends) of the first conductor line pattern having the spiral structure, respectively. The first conductor line pattern having the spiral structure as well as the electrode pattern of the first capacitor electrode 21 and the electrode pattern of the first capacitor electrode 31 provide the electrode pattern illustrated in FIG. 18B. The ninth modification forms capacitance between the two faces that are opposed to each other, making it possible to form larger capacitance than, for example, the configuration example illustrated in FIG. 10 in which the capacitors are formed within the single plane, and to achieve reduction of size of the antenna as a whole. Also, according to the ninth modification, the first conductor line pattern and the second conductor line pattern each have the spiral structure. Thus, not only does the direction of the current "i" that flow in the first half-wavelength resonator 11 become opposite to that of the current "i" that flows in the second half-wavelength resonator 12, but directions of the currents "i" that flow in each of the first half-wavelength resonator 11 and the second half-wavelength resonator 12 partially become opposite to one another. This allows the currents "i" flowing in the first half-wavelength resonator 11 and the second half-wavelength resonator 12 to cancel out more effectively as compared with the embodiments where each of the first half-wavelength resonator 11 and the second half-wavelength resonator 12 is simply in a linear shape, making it possible to further reduce power of radiation for a far distance.

Figure 19A:
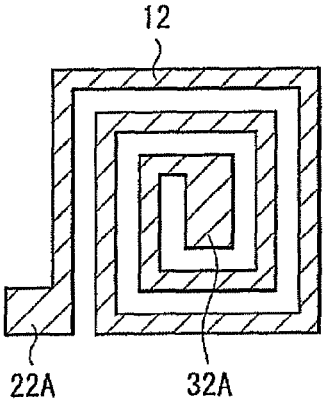
FIGS. 19A to 19C are plan views each illustrating a tenth modification of the concrete configuration of the antenna illustrated in FIG. 1.
Figure 19B:
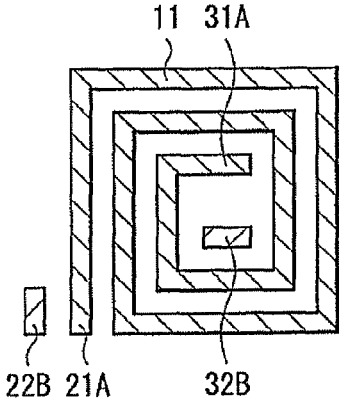
Figure 19C:
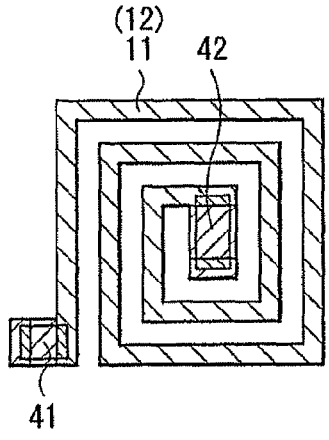

FIGS. 19A to 19C each illustrate a tenth modification. In this modification, for example, conductors having such patterns illustrated in FIGS. 19A and 19B are formed on mutually-opposed two faces of the dielectric substrate which may be in the flat-plate-like shape, respectively. FIG. 19C illustrates a state where the conductor patterns illustrated in FIGS. 19A and 19B are overlapped (caused to oppose each other). For example, the conductor pattern of FIG. 19B may be formed on a top face of the dielectric substrate, whereas the conductor pattern of FIG. 19A may be formed on a bottom face thereof. In the tenth modification, the first conductor line pattern structuring the first half-wavelength resonator 11 and the second conductor line pattern structuring the second half-wavelength resonator 12 each have the spiral structure as in the ninth modification described above.

The tenth modification differs from the ninth modification described above, in that the first capacitor 20 and the second capacitor 30 are capacitor devices that are, as discrete components, independent from the first half-wavelength resonator 11 and the second half-wavelength resonator 12, without configuring the first capacitor 20 and the second capacitor 30 by the electrode patterns of the conductors. More specifically, the first chip capacitor 41 serving as the first capacitor 20 is connected to the first open end (for example, the first end 21A of the first conductor line pattern) of the first half-wavelength resonator 11 and to the first open end (for example, the first end 22A of the second conductor line pattern) of the second half-wavelength resonator 12. The first end 22A of the second conductor line pattern is connected to the first chip capacitor 41 through the first connection conductor 22B that penetrates the dielectric substrate. Also, the second chip capacitor 42 serving as the second capacitor 30 is connected to the second open end (for example, the second end 31A of the first conductor line pattern) of the first half-wavelength resonator 11 and to the second open end (for example, the second end 32A of the second conductor line pattern) of the second half-wavelength resonator 12. The second end 32A of the second conductor line pattern is connected to the second chip capacitor 42 through a second connection conductor 32B that penetrates the dielectric substrate. The tenth modification configures the first capacitor 20 and the second capacitor 30 with the capacitor devices rather than the electrode patterns of the conductors, making it possible to form larger capacitance with smaller area than, for example, the ninth modification described above.

[Second Modification]

Hereinafter, an antenna according to a second embodiment of the technology will be described. Note that the same or equivalent elements as those of the antenna according to the first embodiment described above are denoted with the same reference numerals, and will not be described in detail.

[Basic Configuration of Antenna]

Figure 20:
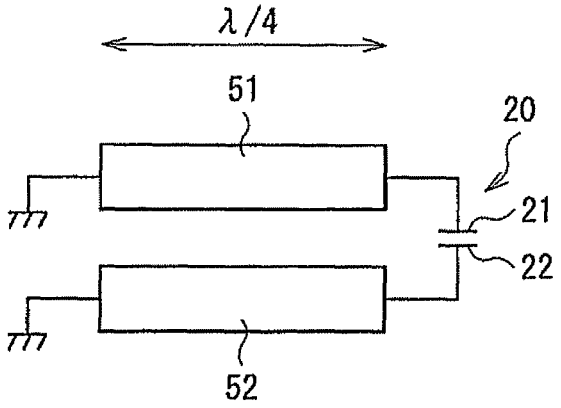
FIG. 20 is a circuit diagram illustrating a basic configuration of an antenna according to a second embodiment of the technology.

FIG. 20 illustrates a basic configuration of the antenna according to the second embodiment of the technology. The antenna is provided with a first quarter-wavelength resonator 51 (for example, the first resonator), a second quarter-wavelength resonator 52 (for example, the second resonator), and the first capacitor 20.

Each of the first quarter-wavelength resonator 51 and the second quarter-wavelength resonator 52 has a first end serving as the open end and a second end serving as a short-circuit end. The first quarter-wavelength resonator 51 and the second quarter-wavelength resonator 52 are so disposed side-by-side to each other that the open ends thereof are opposed to each other and the mutual short-circuit ends thereof are opposed to each other. The first capacitor 20 is connected to the mutually-opposed open ends of the first quarter-wavelength resonator 51 and the second quarter-wavelength resonator 52. The first capacitor electrode 21 of the first capacitor 20 is connected to the first open end of the first quarter-wavelength resonator 51. The second capacitor electrode 22 of the first capacitor 20 is connected to the first open end of the second quarter-wavelength resonator 52.

[Basic Operation and Effect of Antenna]

The configuration of the antenna according to the second embodiment is that in which the antenna according to the first embodiment described above is divided into half at a location where the zero potential is established at the time of resonance (for example, at the physical center line 16 of the resonators where the capacitance Cint1 of the first capacitor 20 and the capacitance Cint2 of the second capacitor 30 are defined as the same). The second embodiment basically achieves effects and advantageous results which are similar to those achieved by the antenna according to the first embodiment described above.

Figure 21:
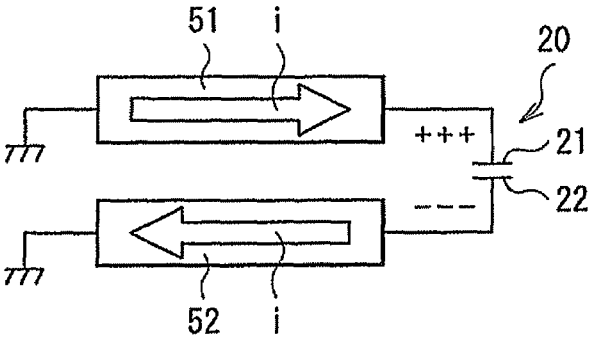
FIG. 21 describes states of a charge distribution and a current vector in the basic resonance mode in the antenna illustrated in FIG. 20.

FIG. 21 illustrates states of a charge distribution and a current vector in the basic resonance mode (the lowest order resonance mode in which the resonance frequency is the lowest) in the antenna according to the second embodiment. In the antenna according to the second embodiment, the first quarter-wavelength resonator 51 and the second quarter-wavelength resonator 52 are so disposed side-by-side to each other that the open ends thereof are opposed to each other, and the mutually-opposed open ends are connected to each other through the first capacitor 20. Thereby, in the basic resonance mode, the electric field distributions are in opposite phase with each other for the first quarter-wavelength resonator 51 and the second quarter-wavelength resonator 52. Thus, in the basic resonance mode, the directions of the currents "i" that flow in the first quarter-wavelength resonator 51 and the second quarter-wavelength resonator 52 are opposite to each other as illustrated in FIG. 21 for the first quarter-wavelength resonator 51 and the second quarter-wavelength resonator 52 (a differential resonance mode is established). Thereby, the currents flowing in the first quarter-wavelength resonator 51 and the second quarter-wavelength resonator 52 cancel out each other for the first quarter-wavelength resonator 51 and the second quarter-wavelength resonator 52, reducing the power of radiation for the far distance in the basic resonance mode. Hence, this makes it possible to prevent a leakage of a signal (for example, an electromagnetic wave) reaching the far-field region, with respect to a signal transmission at a frequency band corresponding to the basic resonance mode.

As in the antenna according to the first embodiment described above, using the two antennas each having the configuration illustrated in FIG. 20 and bringing those antennas close to each other make it possible to achieve the wireless communication unit in which a transmission is performed only with (or only substantially with) the reactance coupling while minimizing the power of radiation to the utmost level, where the antenna according to the second embodiment is also regarded as a coupler, for example. Hence, it is possible to achieve a high speed wireless communication for a short distance, while avoiding an interference of a frequency and a bandwidth with an existing wireless communication system.

[Method of Establishing Connection with Signal Source (Exciting Method of Resonators)]

Figure 22:
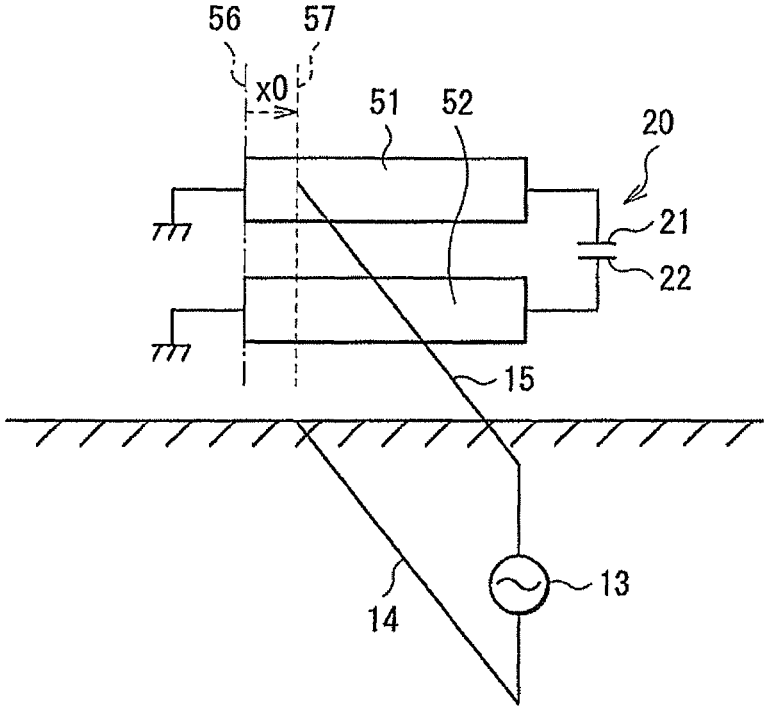
FIG. 22 is a configuration view illustrating an example of an exciting method of resonators in the antenna illustrated in FIG. 20.

FIG. 22 illustrates an example of an exciting method of the resonators in the antenna illustrated in FIG. 20. In this example, the first end (for example, the first connection line 15) of the signal source 13 is connected to the first quarter-wavelength resonator 51 at a position 57 which is separated away from a position 56 of the short-circuit end thereof by a predetermined distance x0, and the second end (for example, the second connection line 14) of the signal source 13 is grounded. It is to be noted that the second end (for example, the second connection line 14) of the signal source 13 may be connected to the short-circuit end of the second quarter-wavelength resonator 52, for example.

The distance x0 in FIG. 22 is set to a value by which the first quarter-wavelength resonator 51 and the signal source 13 are matched (for example, the impedance matching is established). That is, the shorter the distance x0, the smaller the coupling between the first quarter-wavelength resonator 51 and the signal source 13.

[Concrete Configuration Example of Antenna]

The configuration of the antenna according to the second embodiment is that in which the antenna according to the first embodiment described above is divided into half. Thus, a concrete (but not limitative) configuration example thereof may have a configuration in which the configuration according to any one of the concrete configuration examples illustrated in FIGS. 6A and 6B as well as FIGS. 10 to 19C of the first embodiment described above is divided into half. For example, a configuration illustrated in FIGS. 23A to 23C is achieved when the configuration illustrated in FIGS. 15A to 15C are divided into half.

Figures 23A, 23B, 23C:
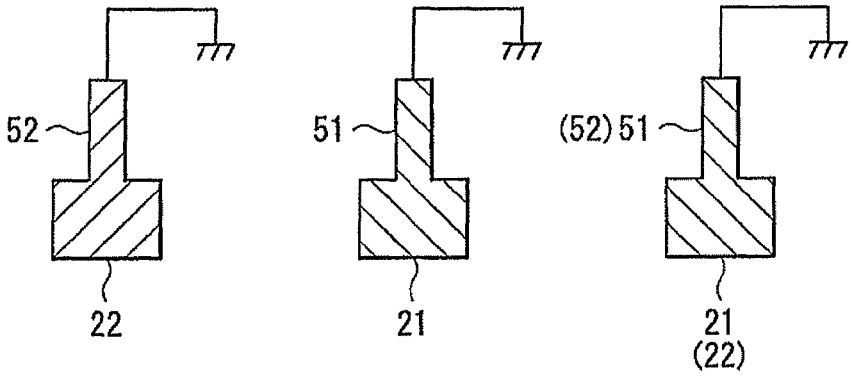
FIGS. 23A to 23C are plan views each illustrating a concrete configuration example of the antenna illustrated in FIG. 20.

For example, conductors having such patterns illustrated in FIGS. 23A and 23B are formed on mutually-opposed two faces of the dielectric substrate which may be in the flat-plate-like shape, respectively. FIG. 23C illustrates a state where the conductor patterns illustrated in FIGS. 23A and 23B are overlapped (caused to oppose each other). For example, the conductor pattern of FIG. 23B may be formed on a top face of the dielectric substrate, whereas the conductor pattern of FIG.

23A may be formed on a bottom face thereof. The electrode pattern illustrated in FIG. 23B includes: the first conductor line pattern structuring the first quarter-wavelength resonator 51; and the electrode pattern of the first capacitor electrode 21 for the first capacitor 20 formed on a portion of the first end (the open end) of the first conductor line pattern, to provide the electrode pattern illustrated in FIG. 23B. The electrode pattern illustrated in FIG. 23A includes: the second conductor line pattern structuring the second quarter-wavelength resonator 52; and the electrode pattern of the second capacitor electrode 22 for the first capacitor 20 formed on a portion of the first end (the open end) of the second conductor line pattern, to provide the electrode pattern illustrated in FIG. 23A. This thereby forms the first capacitor 20 between the two faces that are opposed to each other of the dielectric substrate. In one embodiment, each of the first quarter-wavelength resonator 51 and the second quarter-wavelength resonator 52 is a planar waveguide type resonator. Examples of the planar waveguide type resonator include such as a microstrip line type resonator, an embedded microstrip line type resonator, a coplanar waveguide type resonator, and other suitable line resonators, although it is not limited thereto.

Other Embodiments

Although the technology has been described in the foregoing by way of example with reference to the embodiments and the modifications, the technology is not limited thereto but may be modified in a wide variety of ways.

For example, the antenna according to any one of the embodiments and the modifications described above may be applicable not only to a signal transmission for transmitting and receiving a signal such as an analog signal and a digital signal, but also to a power transmission device used for transmitting and receiving electric power. The technique such as that disclosed in any one of the embodiments and the modifications of the technology described above is applicable to any transmission technique such as, but not limited to, a non-contact power supply technique and a near-field wireless transmission technique.

Also, each of the embodiments and the modifications has the configuration in which the resonators having the conductor line patterns are formed on the dielectric substrate. Alternatively, the resonators may be configured by lumped parameter devices whose electrical length may be half wavelength or quarter wavelength, for example. Further, each of the embodiments and the modifications has the configuration in which the conductor patterns are formed on the top face, the bottom face, or both of the top and the bottom faces of the dielectric substrate. Alternatively, the dielectric substrate may be a multilayer substrate to form the conductor patterns in an inner layer thereof, for example.

Accordingly, it is possible to achieve at least the following configurations from the above-described exemplary embodiments and the modifications of the disclosure.

(1) An antenna, including:

a first resonator and a second resonator each having an open end, the first resonator and the second resonator being disposed side by side to allow the open ends thereof to be opposed to each other; and a first capacitor connected between the open ends which are opposed to each other.

(2) The antenna according to (1), wherein each of the first resonator and the second resonator allows a signal to propagate based on a resonance mode in which a current direction in the first resonator is opposite to that in the second resonator.

(3) The antenna according to (1), wherein each of the first resonator and the second resonator is a planar waveguide type resonator having a conductor line, and the first capacitor is configured with use of a pair of conductor electrode patterns each provided at each of the open ends of the first resonator and the second resonator.

(4) The antenna according to (1), wherein the first capacitor is a capacitor device which is, as a discrete component, independent from the first resonator and the second resonator.

(5) The antenna according to any one of (1) to (4), further comprising a second capacitor, wherein the first resonator is a first half-wavelength resonator having a first open end and a second open end at both ends thereof, respectively, the second resonator is a second half-wavelength resonator having a first open end and a second open end at both ends thereof, respectively, the first capacitor is connected between the first open end of the first half-wavelength resonator and the first open end of the second half-wavelength resonator, and the second capacitor is connected between the second open end of the first half-wavelength resonator and the second open end of the second half-wavelength resonator.

(6) The antenna according to (5), wherein the first half-wavelength resonator is connected, at a position, to a first end of a signal source, the position being away from a resonance center position of the first half-wavelength resonator by a predetermined distance, and the signal source being grounded at a second end thereof.

(7) The antenna according to (5), wherein the first half-wavelength resonator is connected, at a position, to a first end of a signal source, the position being away from a resonance center position of the first half-wavelength resonator by a predetermined distance, and the signal source being connected to the second half-wavelength resonator at a resonance center position thereof.

(8) The antenna according to any one of (1) to (4), wherein the first resonator is a first quarter-wavelength resonator having an open end and a short-circuit end at both ends thereof, respectively, and the second resonator is a second quarter-wavelength resonator having an open end and a short-circuit end at both ends thereof, respectively.

(9) The antenna according to (8), wherein the first quarter-wavelength resonator is connected, at a position, to a first end of a signal source, the position being away from the short-circuit end of the first quarter-wavelength resonator by a predetermined distance, and the signal source being grounded at a second end thereof.

(10) A wireless communication unit, including:

a first antenna transmitting a signal; and a second antenna receiving the signal transmitted from the first antenna, the first antenna including:

a first resonator and a second resonator each having an open end, the first resonator and the second resonator being disposed side by side to allow the open ends thereof to be opposed to each other; and a capacitor connected between the open ends which are opposed to each other.

(11) The wireless communication unit according to (10), wherein the second antenna includes:

a first resonator and a second resonator each having an open end, the first resonator and the second resonator being disposed side by side to allow the open ends thereof to be opposed to each other; and a capacitor connected between the open ends which are opposed to each other, and the first antenna receiving a signal transmitted from the second antenna, the second antenna transmitting the signal to the first antenna, thereby a bidirectional communication through transmitting-receiving the signal is performed between the first antenna and the second antenna.

The present disclosure contains subject matter related to that disclosed in Japanese Priority Patent Application JP 2010-292704 filed in the Japan Patent Office on Dec. 28, 2010, the entire content of which is hereby incorporated by reference.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. An antenna, comprising:

a first resonator extending in a length direction between two ends thereof, the two ends of the first resonator being a first end and a second end, the first end being an open end;

a second resonator extending in a length direction between two ends thereof, the two ends of the second resonator being a third end and a fourth end, the third end being an open end, the first resonator and the second resonator being disposed substantially parallel with each other, such that the length directions of the first and second resonator are substantially parallel with each other, the first end and the third end being at a same side in the substantially parallel length directions and facing each other, the second end and the fourth end being at a same side in the substantially parallel length directions and facing each other; and a first capacitor connected between the first end and the third end.

2. The antenna according to claim 1, wherein each of the first resonator and the second resonator allows a signal to propagate based on a resonance mode in which a current direction in the first resonator is opposite to that in the second resonator.

3. The antenna according to claim 1, wherein each of the first resonator and the second resonator is a planar waveguide type resonator having a conductor line, the first capacitor is configured with a pair of conductor electrode patterns each provided at a respective one of the first end and the third end.

4. The antenna according to claim 1, wherein the first capacitor is a capacitor device which is, as a discrete component, independent from the first resonator and the second resonator.

5. The antenna according to claim 1, further comprising a second capacitor, wherein the first resonator is a first half-wavelength resonator, the second resonator is a second half-wavelength resonator, the second end is an open end, the fourth end is an open and, and the second capacitor is connected between the second end and the fourth end.

6. The antenna according to claim 5, wherein the first half-wavelength resonator is connected, at a position, to a first end of a signal source, the position being away from a resonance center position of the first half-wavelength resonator by a predetermined distance, and the signal source being grounded at a second end thereof.

7. The antenna according to claim 5, wherein the first half-wavelength resonator is connected, at a position, to a first end of a signal source, the position being away from a resonance center position of the first half-wavelength resonator by a predetermined distance, and the signal source being connected to the second half-wavelength resonator at a resonance center position thereof.

8. The antenna according to claim 1, wherein the first resonator is a first quarter-wavelength resonator and the second end being a short-circuit end, and the second resonator is a second quarter-wavelength resonator and the fourth end being a short-circuit end.

9. The antenna according to claim 8, wherein the first quarter-wavelength resonator is connected, at a position, to a first end of a signal source, the position being away from the short-circuit end of the first quarter-wavelength resonator by a predetermined distance, and the signal source being grounded at a second end thereof.

10. A wireless communication unit, comprising:

a first antenna transmitting a signal; and a second antenna receiving the signal transmitted from the first antenna, the first antenna including:

a first resonator extending in a length direction between two ends thereof, the two ends of the first resonator being a first end and a second end, the first end being an open end;

a second resonator extending in a length direction between two ends thereof, the two ends of the second resonator being a third end and a fourth end, the third end being an open end, the first resonator and the second resonator being disposed substantially parallel with each other such that the length directions of the first and second resonator are substantially parallel with each other, the first end and the third end being at a same side in the substantially parallel length directions and facing each other, the second end and the fourth end being at a same side in the substantially parallel length directions and facing each other; and a first capacitor connected between the first end and the third end.

11. The wireless communication unit according to claim 10, wherein the second antenna includes:

a third resonator extending in a length direction between two ends thereof, the two ends of the third resonator being a fifth end and a sixth end, the fifth end being an open end;

a fourth resonator extending in a length direction between two ends thereof, the two ends of the fourth resonator being a seventh end and a eighth end, the seventh end being an open end, the third resonator and the fourth resonator being disposed substantially parallel with each other such that the length directions of the third and fourth resonators are substantially parallel with each other, the fifth end and the seventh end being at a same side in the substantially parallel length directions and facing each other, the sixth end the eighth end being at a same side in the substantially parallel length directions and facing each other; and a third capacitor connected between the fifth end and the seventh end, the first antenna receiving a signal transmitted from the second antenna, the second antenna transmitting the signal to the first antenna, thereby performing a bidirectional communication through transmitting-receiving the signal between the first antenna and the second antenna.

* * * * *